United States Patent [19]

Larsson et al.

[11] 3,930,739

[45] Jan. 6, 1976

[54] MANHOLE FRAME WITH ADJUSTMENT SCREWS

[76] Inventors: Folke J. Larsson; Rune H. Larsson, both of Box 32, 540 42 Forsvik, Sweden

[22] Filed: Apr. 18, 1974

[21] Appl. No.: 461,939

Related U.S. Application Data

[63] Continuation-in-part of Ser. No. 282,829, Aug. 22, 1972, Pat. No. 3,858,998.

[52] U.S. Cl. ..... 404/26; 404/25

[51] Int. Cl.[2] ..... E02D 29/14

[58] Field of Search ..... 404/25, 26

[56] References Cited

UNITED STATES PATENTS

| | | | |
|---|---|---|---|
| 1,076,386 | 10/1913 | O'Day | 404/26 |
| 2,930,295 | 3/1960 | Hale | 404/26 |
| 3,263,579 | 8/1966 | Dorris | 404/26 |
| 3,773,428 | 11/1973 | Bowman | 404/26 |

*Primary Examiner*—Mervin Stein
*Assistant Examiner*—Steven Hawkins
*Attorney, Agent, or Firm*—Ulle C. Linton

[57] ABSTRACT

A manhole frame with adjustment screws for raising and lowering said frame has in its inner surface pockets or recesses each communicating with a hole for guiding of the adjustment screws. The recesses serve to receive nuts for the screws and the recesses are shaped so as to permit the sideways of said nuts. The recesses also constitute drainages for the screw holes.

3 Claims, 3 Drawing Figures

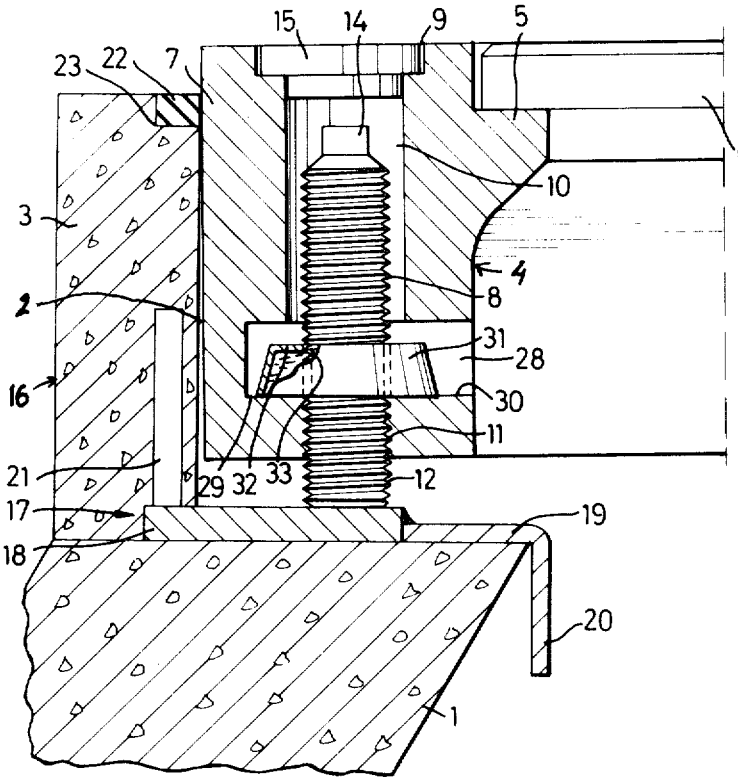
Fig. 1
Fig. 2
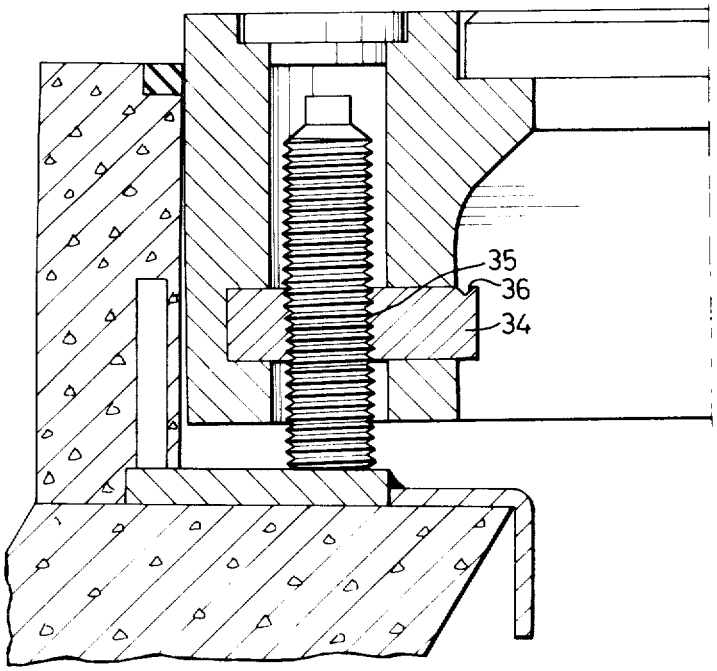

MANHOLE FRAME WITH ADJUSTMENT SCREWS

The present application is a continuation-in-part of our copending application Ser. No. 282,829, filed Aug. 22, 1972, now U.S. Pat. No. 3,858,998 which issued Jan. 7, 1975.

This invention refers to a manhole frame provided with adjustment screws for raising and lowering said frame.

Manhole frames intended to be located in roadways and the like have to be given correct position relative to the street-paving, In resurfacing of a street or a highway the manhole frame has to be raised to accomodate itself to the new level of the street-paving. A lowering is actual when the level of the street has been lowered. In order to solve this problem manhole frames having adjustment screws have been designed. As the manhole frames are generally made from pig iron and as it further cannot be avoided that water, dirt, and the like may reach the screws and the threaded parts of the frame it is obvious that these adjustable manhole frames are very exposed to function disturbances and that the lifetime of such manhole frames is relatively short.

Thus the main object of the invention is to eliminate these and other disadvantages.

Reference is made to the accompanying drawing illustrating two preferred embodiments of the invention FIG. 1 is a section through part of the manhole frame according to the first embodiment and the upper part of the manhole cooperating therewith.

FIG. 2 is a similar view through the second embodiment.

Figure 3:
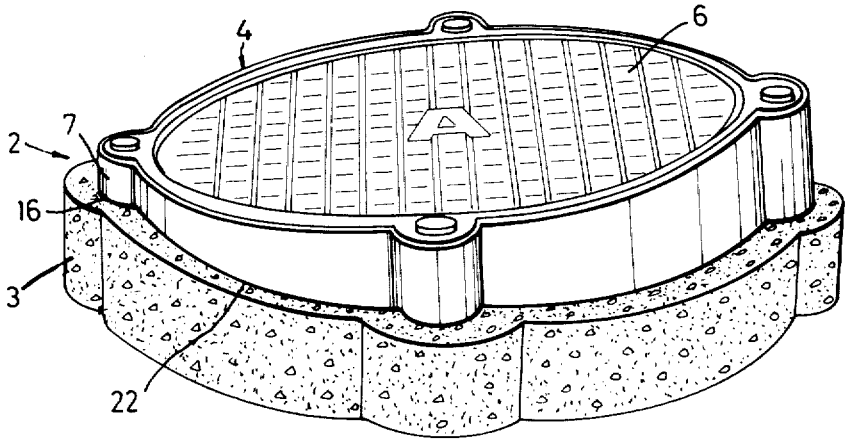
FIG. 3 is a perspective view of the manhole frame.

Referring to the drawing numeral 1 designates a conical concrete ring constituting the upper part of the manhole. The new manhole frame is generally designated 2 and comprises an outer ring 3 which may be made from wood, concrete on the like and an inner ring, generally designated 4, and preferably made from pig iron. Said inner ring is provided with an inwardly directed preferably annular portion 5 intended to serve as a guide and support for a cover or grating 6. The ring 4 further has a number of radially extending lugs 7. The lugs 7 are intended to receive adjustment screws 8. For this purpose a hole 9 is provided in each lug. Said hole communicates with a narrower hole coaxial therewith, 10. The last-mentioned hole continues according to the first embodiment in a threaded part 11 the thread of which cooperates with the thread 12 of the adjustment screw. The screw 8 has a square end 14. The hole or opening 9 may be closed by means of a closure 15 preferably made from a plastic material and intended to prevent that water, dirt and the like may reach the screw. The outer ring 3 is provided with grooves 16 for the lugs 7 of the inner ring and has centering means for cooperation with the upper part of the manhole as well as support surfaces against which the free ends of the adjustment screws are intended to act. For this purpose there are secured to the outer ring a number of elements having the general designation 17. In the illustrated embodiment these elements comprise a horisontal relatively thick plate 18 having its under side flush with the under side of the outer ring 3. Welded to the plates 18 are relatively weak irons 19 which are directed towards the centre of the outer ring, Initially they are plan or feably pre-bent so as to be accomodated to the actual manhole opening by being bent to form downwardly extending ends 20 serving to center the outer ring relative to the manhole opening. The relatively weak irons 19 make it possible to adapt the frame for manholes of different widths. A further advantage is that damages upon the manhole which may occur when a caterpillar or the like during installation of the manhole frame unintentionally comes into contact with the frame are eliminated in that the irons 19 deflect. Each plate 18 is fastened to the outer ring by means of securing means such as studs 21 or similar which may be molded in the part of the outer ring 3 in which the lugs of the inner ring are to be guided. The grooves 16 adapted in the outer ring for said purpose are somewhat bigger than the corresponding shape of the lugs such that a certain clearance is apparent between the grooves and the lugs. In a similar manner the inner diameter of the outer ring 3 somewhat exceeds the outer diameter of the inner ring 4.

In order to prevent as much as possible that coarse sand, asphalt or the like may enter between the frame parts and also into the threads of the adjustment screws a resiliently compressible sealing 22 may be fitted in an internal groove 23 adapted in the upper part of ring 3. Said sealing may be glued to the ring and also serves as a shock absorber.

It is evident that the outer ring in this embodiment will always be centered relative to the manhole opening at the same time as the inner ring within the tolerances between the outer dimension of the inner ring and the inner dimension of the outer ring may be inclined relative to this one and consequently also in relation to the upper part of the well. By means of the elements molded in the outer ring there is obtained in addition to the exact centering of the manhole frame also that the plates 18 which are intended to take up the load from the adjustment screws and consequently the total load upon the manhole frame are always correctly located and must only be dimensioned according to the actual load.

The inner ring is provided with recesses or side openings 28 which open into the interior of the ring and extend beyond the holes 10 in a horizontal direction. These recesses are preferably rectangular in section and serve as drainage holes for water and the like which may have reached the holes 10. The lower surfaces 29, 30 of said recesses also serve as support surfaces for for instance a plastic cup 31 having in its bottom 32 (facing upwardly) a threaded hole 32 cooperating with the thread of the screw 8. Such a cup may be filled with grease and then maintains the screw in a good well greased condition. At the same time it forms an effective sealing between the hole 10 and the threaded part 11. The main object of the recess is however according to FIG. 2 to receive a block 34 having a threaded hole 35 for cooperation with the screw 8. Thus - when the threaded part 11 has been worn or damaged it may be drilled up and substituted by the block 34. Of course the threaded part 11 may also be omitted from the beginning, the block serving the purpose of said threaded part which is the case in the embodiment illustrated in FIG. 2. In order to facilitate the removal of the block it may have a groove 36 permitting an iron bar or a similar tool to be introduced therein. It is obvious that the possibility of easy and rapid substitution of the blocks 34 solves the problems referred to in the preamble of the specification.

We claim:

1. Manhole frame comprising a lid, adjustment screws, an annular member adapted to cover the manhole opening and having a rim for supporting said lid, said annular member having at least three axially extending holes located at a peripheral distance from each other and each having a diameter which slightly exceeds the diameter of a corresponding one of said adjustment screws, said annular member having further non-circular openings extending radially from the interior surface thereof and crossing said holes, removable blocks each having a shape and dimension corresponding to and being radially inserted in one of said side openings and a threaded hole having one of said screws extending therethrough and said screws being provided at their upper end with means for facilitating their turning, cup-shaped flexible members each having a threaded bottom opening having one of said screws extending therethrough and end portions positioned on one of said blocks.

2. Manhole frame comprising a lid, adjustment screws, an annular member adapted to cover the manhole opening and having a rim for supporting said lid, said annular member having at least three axially extending holes located at a peripheral distance from each other and each having a diameter which slightly exceeds the diameter of a corresponding one of said adjustment screws, said annular member having further non-circular openings extending radially from the interior surface thereof and crossing said holes, removable blocks each having a shape and dimension corresponding to and being radially inserted in one of said side openings and a threaded hole having one of said screws extending therethrough, and said screws being provided at their upper end with means for facilitating their turning, an outer annular member surrounding, but spaced from said first mentioned annular member, at least three irons extending inwardly from said outer annular member and capable of being bent so as to project into the manhole opening thereby centering said outer member relative to the manhole opening, support members extending inwardly from said outer member with one of said screws supported on one of said support members, lugs projecting radially from said first mentioned member, said outer member being correspondingly shaped with internal recesses for said lugs and said support members each bridge one of said recesses.

3. Manhole frame comprising a lid, adjustment screws, an annular member adapted to cover the manhole opening and having a rim for supporting said lid, said annular member having at least three axially extending holes located at a peripheral distance from each other and each having a diameter which slightly exceeds the diameter of a corresponding one of said adjustment screws, said annular member having further non-circular openings extending radially from the interior surface thereof and crossing said holes, removable blocks each having a shape and dimension corresponding to and being radially inserted in one of said side openings and a threaded hole having one of said screws extending therethrough, and said screws being provided at their upper end with means for facilitating their turning, an outer annular member surrounding, but spaced from said first mentioned member, at least three irons extending inwardly from said outer annular member and capable of being bent so as to project into the manhole opening thereby centering said outer member relative to the manhole opening, support members extending inwardly from said outer member with one of said screws supported on one of said support members, said outer member having a groove following the interior surface of said member and a sealing ring seated in said groove and positioned for contacting said first mentioned member.

* * * * *